United States Patent [19]

Guzzle et al.

[11] 4,189,144

[45] Feb. 19, 1980

[54] GOLF CLUB

[75] Inventors: Timothy L. Guzzle; Eugene L. Sheeley, both of Fort Worth, Tex.

[73] Assignee: AMF Incorporated, White Plains, N.Y.

[21] Appl. No.: 785,175

[22] Filed: Apr. 6, 1977

Related U.S. Application Data

[63] Continuation-in-part of Ser. No. 706,957, Jul. 20, 1976, abandoned.

[51] Int. Cl.[2] ..... A63B 53/00

[52] U.S. Cl. ..... 273/77 R; 273/81 R; 273/167 F

[58] Field of Search ..... 273/77 R, 77 A, 80 R, 273/80 A, 80 B, 81 R, 81 A, DIG. 7, 23, 167 F, 169, 171

[56] References Cited

U.S. PATENT DOCUMENTS

| | | | |
|---|---|---|---|
| 1,594,801 | 8/1926 | Stackpole | 273/80 A X |
| 2,066,962 | 1/1937 | Cross | 273/80 A X |
| 2,236,414 | 3/1941 | Reach | 273/80 A X |
| 2,772,090 | 11/1956 | Brandon | 273/81 A |
| 3,655,188 | 4/1972 | Solheim | 273/77 A |
| 3,698,239 | 10/1972 | Everett | 273/77 A X |
| 3,809,403 | 5/1974 | Hunter | 273/80 B |
| 3,871,649 | 3/1975 | Kilshaw | 273/77 A |
| 3,941,390 | 3/1976 | Hussey | 273/169 |

FOREIGN PATENT DOCUMENTS

| | | | |
|---|---|---|---|
| 1261541 | 1/1972 | United Kingdom | 273/DIG. 23 |

OTHER PUBLICATIONS

"Golf Digest", Mar. 1974, pp. 54–58.
"Golf Digest", Jun. 1970, pp. 95–99.
"Golf Digest", Jul. 1971, pp. 28–41.
"Golf Digest", Dec. 1971, pp. 24–29.

*Primary Examiner*—Richard J. Apley
*Attorney, Agent, or Firm*—George W. Price; Walter Lewis

[57] ABSTRACT

A golf club of a predetermined swingweight and having a reduced total weight and reduced moment of inertia as compared to conventional clubs of the same swingweight. In construction, the golf club has a butt end section of reduced weight, and the weight of the club head is reduced in relation to the reduction in weight of the butt end section to maintain the same swingweight.

5 Claims, 6 Drawing Figures

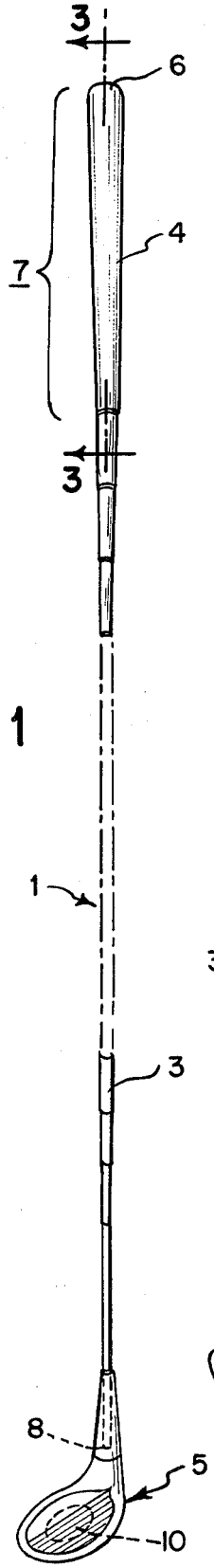
FIG. 1
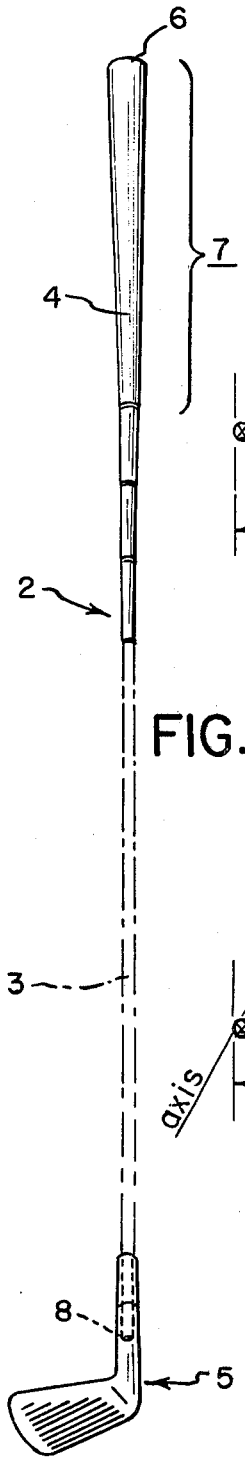
FIG. 2
FIG. 5
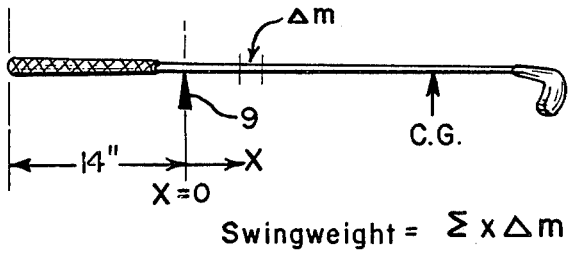
FIG. 6
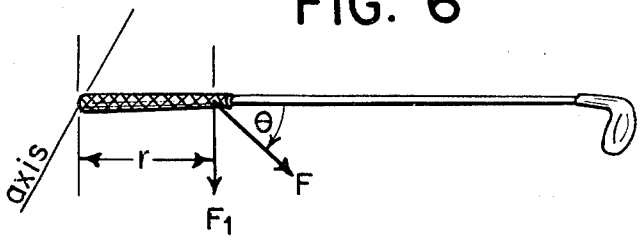

GOLF CLUB

RELATED APPLICATION

This application is a continuation-in-part of our earlier copending application for "Weight Reduction in Golf Clubs", Ser. No. 706,957, filed July 20, 1976, now abandoned.

BACKGROUND OF THE INVENTION

For some time, the golf equipment industry has been seeking ways of constructing lighter golf clubs. A number of approaches have been taken including the use of shafts constructed of graphite-epoxy and other composite materials. Such clubs have generally included heavier heads to obtain the required swingweight for the club. Another approach directed at improving the quality of golf clubs includes the use of shaft constructions with specific flexing characteristics. Matching of the different clubs in a golf club set has also been used to increase the performance of the clubs. The clubs in a set may be matched in different ways; and one way which has become generally accepted is to match the clubs in accordance with their swingweight which is a static measurement of the weight distribution of the club. Further effort has been directed toward matching the dynamic qualities of the clubs in a set. Here, consideration may be given to such features as the frequency of vibration of the clubs, their total weight, location of center of gravity and the overall feel of the clubs to the player.

The prior art modifications which have been made to golf clubs over the years have generally improved their performance. Nevertheless, there is still room for further improvement in both the club performance and feel to the player.

SUMMARY OF THE PRESENT INVENTION

In accordance with the teachings of the present invention, applicants have reduced the overall weight of the conventional golf club and at the same time correlated this weight reduction with a reduction in the moment of inertia of the club. Taking a conventional club, these reductions are effected while maintaining the same swingweight of the club. The resulting club provides better control for the player and requires less effort to swing while giving greater head velocity.

In construction, the overall weight of the club is reduced primarily by reducing the thickness of the grip at the butt end section of the shaft. This reduction in the grip thickness is effected without significantly changing the overall outside diameter of the butt end section as compared to conventional clubs. This in turn is made possible by enlarging the diameter of the butt end section of the shaft while reducing its thickness.

With the reduction in the weight of the butt end section of the club, the club head is then reduced in weight by a correlated amount to provide a club having the same swingweight as a comparable club not having the reduced weight. The reduction in the weight of the club head adds to the total reduction of the club weight and also is a primary factor in reducing the moment of inertia of the club. The combination of these weight reductions also has the effect of shifting the center of gravity of the club toward the club head which is significant to the feel of the club as it is swung by the player.

The improved golf club construction of the present invention has an acceptable overall appearance no different from conventional clubs, and has improved performance characteristics both in the feel of the club to the player and from the technical aspects of the club. The energy required to swing the club is less than in a comparable conventional club. At the same time, an increase in the club head velocity is produced as well as an increase in the carry distance of the golf ball. The control and consistency of the performance of the club is also improved.

BRIEF DESCRIPTION OF THE DRAWINGS

FIG. 1 is a view of a golf club wood constructed in accordance with the teachings of the present invention;

FIG. 2 is a view of a golf club iron constructed in accordance with the teachings of the present invention;

FIG. 5 is a schematic view representing the swingweight balancing of a golf club; and FIG. 6 is a schematic view showing the forces relating to the calculation of the moment of inertia of the club.

DETAILED DESCRIPTION OF THE PREFERRED EMBODIMENTS

Figure 3:
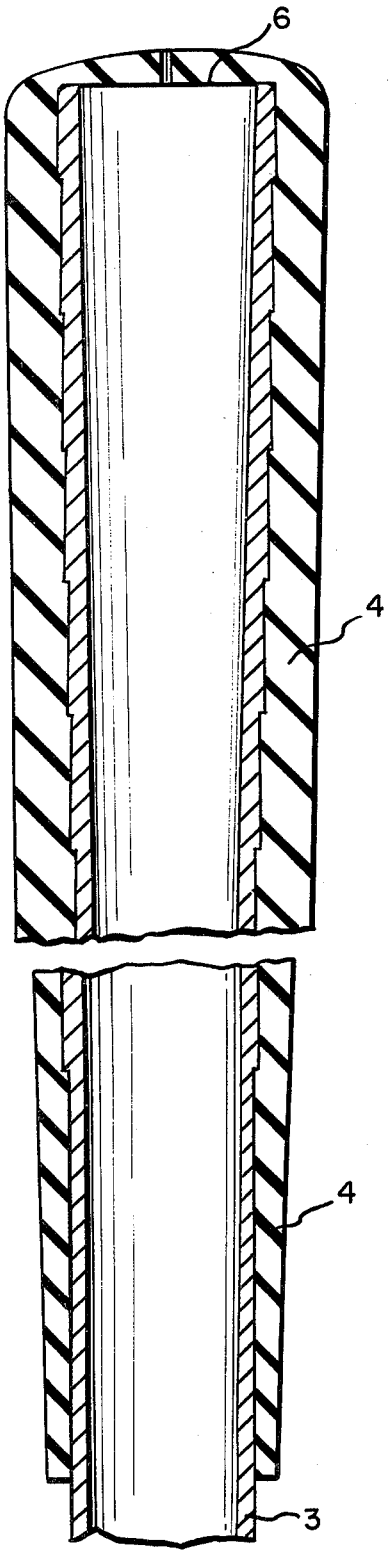
FIG. 3 is an enlarged cross-sectional view taken along lines 3—3 of FIG. 1 showing the improved construction of the butt end section of the golf club.

FIGS. 1 and 2 generally show the wood 1 and iron 2 normally included in a golf club set. Both clubs include a club shaft 3, grip 4, and club head 5. The shaft is generally described in terms of having a butt end 6, butt end section 7, which generally corresponds in length to the length of the grip 4, and a head end 8.

Figure 4:
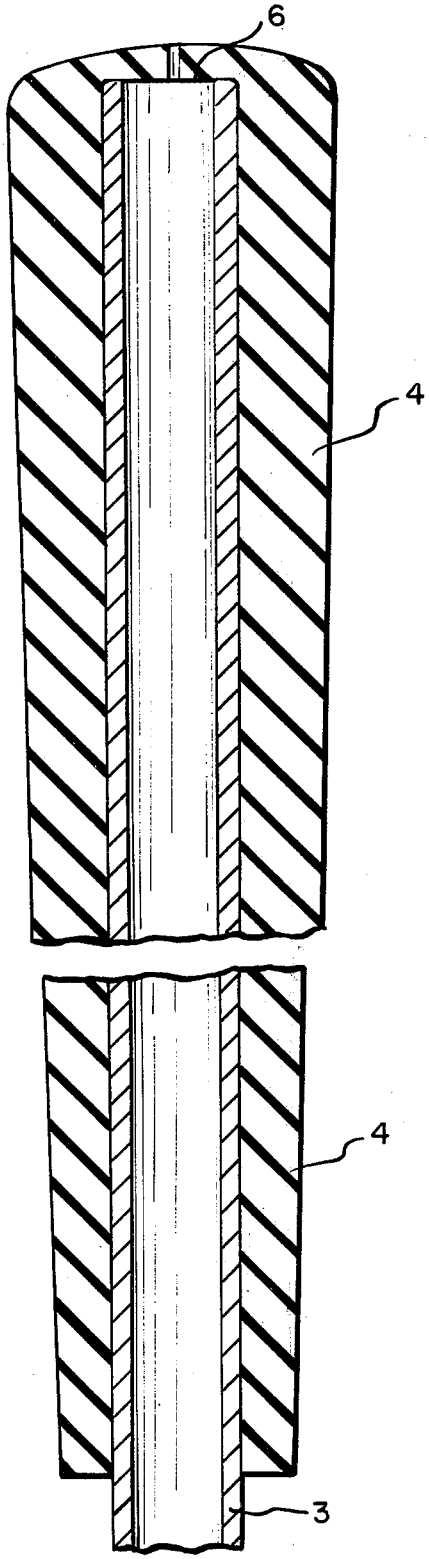
FIG. 4 (Prior Art)
FIG. 4 is a cross-sectional view similar to FIG. 3 showing the conventional construction of the butt end section of a golf club.

FIG. 3 is a cross-sectional view of the butt end section 7 of the golf club wood 1 of FIG. 1 showing in detail the construction thereof. From FIG. 3 it is seen that the butt end section 7 of the shaft 3 is tapered outwardly toward the butt end 6 of the shaft and has a thickness which decreases toward the butt end. FIG. 3 also shows the construction of the grip 4 which overlies the butt end section 7 of the shaft 3. For comparison, FIG. 4 is included to show the typical construction of the butt end section of a golf club of conventional construction. From FIGS. 3 and 4, it is seen that the thickness of the grip 4 of applicants' improved golf club is reduced relative to the conventional grip construction. This is done while maintaining about the same overall outside diameter of the club in the butt end section. In most conventional golf clubs, the weight of the grip accounts for a large percentage of the total weight of the butt end section of the club. Therefore, a reduction in the thickness of the grip produces a significant reduction in the weight of the butt end section.

Tables A and B below give the dimensions for a number one wood and number two iron constructed in accordance with the teachings of the present invention. For comparison, comparable figures of a typical prior art construction are given in parentheses.

TABLE A

| Location | #1 Wood Clubs Shaft (Outer diameter) Invention | Prior Art | Shaft (Thickness) Invention | Prior Art | Grip (Outer diameter) Invention | Prior Art |
|---|---|---|---|---|---|---|
| 1 | .712 | (.620) | .010 | (.012) | | |
| 2 | .706 | (.620) | .010 | (.012) | | |
| 3 | .700 | (.620) | .01025 | (.012) | .933 | (.924) |
| 4 | .694 | (.620) | .01025 | (.012) | | |
| 5 | .688 | (.620) | .01025 | (.012) | .882 | (.872) |
| 6 | .682 | (.620) | .01025 | (.012) | | |
| 7 | .676 | (.620) | .01025 | (.012) | .860 | (.845) |
| 8 | .670 | (.620) | .0105 | (.012) | | |
| 9 | .664 | (.620) | .011 | (.012) | .835 | (.827) |
| 10 | .658 | (.620) | .011 | (.012) | | |
| 11 | .652 | (.620) | .011 | (.012) | .795 | (.801) |
| 12 | .646 | (.620) | .011 | (.012) | | |
| 13 | .640 | (.620) | .0115 | (.012) | .773 | (.777) |
| 14 | .634 | (.606) | .0115 | (.0122) | | |
| 15 | .628 | (.606) | .0115 | (.0122) | .740 | (.755) |
| 16 | .622 | (.606) | .0115 | (.0122) | | |
| 17 | .616 | (.606) | .01175 | (.0122) | .719 | (.748) |
| 18 | .610 | (.606) | .01175 | (.0122) | | |
| 19 | .595 | (.590) | .012 | (.01225) | .700 | (.713) |
| 20 | .580 | (.570) | .01225 | (.0125) | | |
| 21 | .565 | (.550) | .0125 | (.01275) | | |
| 22 | .550 | (.530) | .01275 | (.013) | | |
| 23 | .530 | (.515) | .01275 | (.0135) | | |
| 24 | .510 | (.500) | .01325 | (.01375) | | |
| 25 | .490 | (.485) | .0135 | (.01375) | | |
| 26 | .470 | (.470) | .0135 | (.014) | | |
| 27 | .455 | (.455) | .01375 | (.01425) | | |
| 28 | .440 | (.440) | .014 | (.01425) | | |
| 29 | .425 | (.425) | .01425 | (.0145) | | |
| 30 | .410 | (.410) | .0145 | (.015) | | |
| 31 | .395 | (.398) | .015 | (.015) | | |
| 32 | .382 | (.385) | .015 | (.0155) | | |
| 33 | .370 | (.370) | .01525 | (.016) | | |
| 34 | .355 | (.350) | .0155 | (.0165) | | |
| 35 | .301 | (.301) | .01775 | (.01725) | | |

TABLE B

| Location | #2 Iron - S flex Shaft (Outer diameter) Invention | Prior Art | Shaft (Thickness) Invention | Prior Art | Grip (Outer diameter) Invention | Prior Art |
|---|---|---|---|---|---|---|
| 1 | .688 | (.600) | .01125 | (.012) | | |
| 2 | .682 | (.600) | .01125 | (.012) | | |
| 3 | .676 | (.600) | .01125 | (.012) | | |
| 4 | .670 | (.600) | .01125 | (.012) | .933 | (.921) |
| 5 | .664 | (.600) | .01125 | (.012) | | |
| 6 | .658 | (.600) | .01125 | (.012) | .882 | (.874) |
| 7 | .652 | (.600) | .0115 | (.012) | | |
| 8 | .646 | (.600) | .0115 | (.012) | .860 | (.854) |
| 9 | .640 | (.600) | .0115 | (.012) | | |
| 10 | .634 | (.600) | .01175 | (.012) | .835 | (.835) |
| 11 | .628 | (.600) | .01175 | (.012) | | |
| 12 | .622 | (.600) | .012 | (.012) | .795 | (.807) |
| 13 | .616 | (.585) | .01225 | (.0125) | | |
| 14 | .610 | (.585) | .01225 | (.0125) | .773 | (.776) |
| 15 | .604 | (.585) | .01225 | (.0125) | | |
| 16 | .598 | (.585) | .0125 | (.0125) | .740 | (.753) |
| 17 | .590 | (.585) | .01225 | (.0125) | | |
| 18 | .578 | (.570) | .0125 | (.01275) | .719 | (.729) |
| 19 | .558 | (.550) | .013 | (.013) | | |
| 20 | .538 | (.530) | .013 | (.01325) | .700 | (.705) |
| 21 | .518 | (.510) | .0135 | (.01325) | | |
| 22 | .500 | (.490) | .0135 | (.0135) | | |
| 23 | .485 | (.475) | .01375 | (.014) | | |
| 24 | .470 | (.460) | .0140 | (.014) | | |
| 25 | .450 | (.445) | .0145 | (.01425) | | |
| 26 | .435 | (.430) | .0145 | (.01475) | | |
| 27 | .420 | (.415) | .01475 | (.015) | | |
| 28 | .405 | (.400) | .01525 | (.017) | | |
| 29 | .355 | (.355) | .0235 | (.02325) | | |

The specifications given in Table A are for a wood having an S flex and swingweight of D3. The dimensions are given for locations along the length of the club. In particular, location 1 extends for 5/16" from the butt end; locations 2–18 are ½" increments and cover a total length of 8½"; locations 19–23 are at 2" increments for a length of 10"; and locations 24–33 are 1¼" increments for a length of 12½". Locations 34 and 35 give the measurements just below location 33 and at the head end 8 of the shaft, respectively. Locations 34 and 35 cover a distance of 119/16". The shaft here is tapered at 0.0075" per inch.

Table B sets out the dimensions for a number two iron having an S flex and swingweight of D3. In Table B, location 1 covers an increment of ⅛"; locations 2–17 are ½" increments for a length of 8"; locations 18–22 are at 2" increments for a length of 10"; locations 23–27 are at 1¼" increments for a length of 6¼". Locations 28 and 29 are the increments immediately below location 24 and at the head end of the shaft, respectively. The taper of the shaft here is 0.0075" per inch.

Tables A and B show an enlargement of the shaft and a reduction of its wall thickness generally at the butt end section of the club. Although this is the presently preferred construction, it is possible to enlarge the diameter of the shaft for a length below the grip and to also decrease its thickness along this length. Appearance and drag disadvantages, however, must be considered in increasing the diameters of the center and lower portions of the shaft. Also, consideration must be given to the desired reduction in moment of inertia effected with applicants' invention. Generally, decreasing the weight of the shaft below the butt end section works against increasing the moment of inertia.

Although Tables A and B are specific to the dimensions of a number one wood and a number two iron having an S flex and a swingweight of D3, similar measurements can be taken for all other wood and iron clubs at the different flexes and swingweights. Only the measurements of Tables A and B are shown for purposes of simplicity. In construction, the other shafts and grips will be made in accordance with the same principles as shown in Tables A and B.

With the presently preferred construction, the shafts for the improved golf clubs are constructed of 4140 steel alloy. This same material is also used in the shafts generally referred to as lightweight steel shafts and in conventional steel shafts which weigh about ½ oz. more. The grip 4 of applicants' improved club is of molded rubber dimensioned to slip over the butt end section of the shaft.

In determining the amount of reduction in the wall thickness of the shaft at the butt end section, consideration has been given to the bending strength of the shaft. Conventional shafts generally have bending strengths at different points along the length of the shaft which can be measured by appropriate equipment and mathematical calculations. In accordance with applicants' invention, the bending strength of the shaft construction shown in FIG. 3 has been made about equal to the bending strength of a conventional club constructed of the same material but without the reduced thickness and enlargement at the butt end section. With the increased diameters, the same bending properties can be obtained with less material. Therefore, the weight of the shaft itself can be reduced in the butt end section.

In mathematically determining the bending strength of the shaft at any point along its length, equation 1 as set out below can be used.

(Equation 1)

$$I = \pi r^3 t\left[1 - \frac{3}{2}\left(\frac{t}{r}\right) + \left(\frac{t}{r}\right)^2 - \frac{1}{4}\left(\frac{t}{r}\right)^3\right]$$

where:

t = wall thickness at the section r = outside radius of the section

Equation 1 gives the bending moment of inertia of a section of the shaft as a function of its radius (r) and its wall thickness (t). The value calculated by this equation must be multiplied by the elastic modulus of the steel to obtain the bending strength. Equation 1 shows that when the diameter of the shaft becomes large compared to its wall thickness, the bending strength is proportional to the third power of the radius and only to the first power of the shaft thickness. Therefore, since the cross-sectional area of the section given by the expression $A = 2\pi rt$ depends equally on these two variables, it is possible to maintain a constant bending strength and use less material by increasing the section diameter and reducing its wall thickness.

In both the woods and irons represented by Tables A and B, as well as in other clubs employing the same principles, manufacturing techniques and tolerances may limit the size and thickness dimensions. In the case of the clubs of Tables A and B, for example, the manufacturing procedure used in constructing the shafts limited the thickness reduction at the butt end of the shaft so that actually the shaft is slightly thicker here than necessary to give the desired bending strength. Nevertheless, this is not a significant difference and can be avoided by using other manufacturing techniques.

As indicated above, applicants' improved golf club results in a reduction in the total weight of the club and in its moment of inertia, which features will be discussed in more detail below. These reductions are made while maintaining the same swingweight as that of a comparable club not having such reductions. Generally, golf clubs are matched in sets and sold according to swingweight. An accepted definition of the swingweight of a golf club is the measurement of the unbalanced torque about a point 14 inches from the butt end of the club. As indicated in the schematic of FIG. 5, torque is a vector quantity and the contributions of the mass elements ($\Delta m$) to the left of the fulcrum 9 are negative.

Swingweights are not specified in engineering units of torque. Rather they are designated using a system involving a letter followed by a number. The range of swingweights for men's clubs is from D0 to D7, with ladies' clubs having lower torques and designated C6 to C9. The lower the letter and the number, the lower the swingweight or unbalanced torque. Mathematically, swingweights are measured in oz.in. C6 is equivalent to 207.76 oz.in. Each successively higher swingweight can be calculated by adding 1.76 oz.in. for each swingweight point. This gives a value of 213.04 oz.in. for C9, 214.8 oz.in. for D0, and 227.12 oz.in. for D7.

From a technical standpoint, swingweight is a good basis for matching clubs in sets and describing their properties. Swingweight, or torque, a static variable, is the first moment of mass. The two important dynamic variables, weight and moment of inertia, are the zeroth and second moments, respectively. Thus, since the swing is a combination of translation and rotation, the first moment is a good compromise.

As noted with respect to Tables A and B, the clubs have a swingweight of D3 which is equivalent to 220.08 oz.in. In order to maintain this swingweight after reducing the weight of the butt end section 7 of the club, applicants have made a weight reduction in the club head. This not only results in a club having the same swingweight as the comparable conventional club, but one having the added advantage of a reduced dynamic moment of inertia. In construction, the weight of the head in the wood is reduced by reducing the amount of lead 10 contained in the center of the head. This lead is located generally behind the point of impact the head will have with the golf ball. With respect to the irons, the weight reduction of the head is effected by thinning the blade portion of the head.

Tables C and D below give a breakdown of the weights, in grams, and percentage weights of the different sections of the clubs constructed in accordance with the teachings of the present invention and also of comparable conventional clubs. Tables C and D also give the dynamic moment of inertia in oz.in.$^2$ for each of the clubs and the location of the center of gravity in inches as measured from the heel of the club head 5 in a direction along the length of the shaft.

TABLE C

| | #1 Wood Clubs | | | | | | | | | | | | | | | | |
|---|---|---|---|---|---|---|---|---|---|---|---|---|---|---|---|---|---|
| | 1-R | 1-S | 1-X | 2-R | 2-S | 2-X | 3-S | 4-S | 5-S | 6-S | 7-S | 8-S | 9-S | 10-S | 11-S | 12-S | 13-S |
| (A) Total Club Wt. | 343.5 | 342.8 | 342.3 | 370.1 | 367.6 | 370.2 | 353.6 | 375.1 | 393.5 | 374.4 | 382.4 | 383.0 | 373.7 | 392.5 | 370.2 | 381.1 | 371.8 |
| (B) Shaft Wt. | 103.4 | 106.6 | 109.1 | 105.0 | 108.1 | 111.6 | 84.9 | 119.5 | 118.6 | 116.8 | 120.4 | 122.1 | 119.3 | 123.4 | 115.0 | 122.3 | 113.1 |
| (C) Head Wt. | 202.3 | 200.2 | 199.3 | 210.1 | 207.5 | 207.0 | 214.2 | 202.2 | 216.2 | 202.8 | 204.4 | 205.1 | 199.2 | 209.4 | 203.1 | 202.0 | 203.2 |
| (D) Grip Wt. | 34.0 | 31.9 | 29.2 | 51.7 | 48.2 | 48.1 | 51.0 | 50.0 | 55.3 | 51.4 | 54.2 | 52.4 | 51.8 | 56.3 | 48.7 | 53.4 | 52.1 |
| (E) Butt w/o Grip Wt. | 26.8 | 28.2 | 28.0 | 27.5 | 27.1 | 28.0 | 25.8 | 34.0 | 36.9 | 31.5 | 33.7 | 32.9 | 31.8 | 32.0 | 32.8 | 33.3 | 29.9 |
| (F) Butt w/Grip Wt. | 64.6 | 64.2 | 60.9 | 81.5 | 78.7 | 79.1 | 79.8 | 87.9 | 92.2 | 82.9 | 87.9 | 85.3 | 83.6 | 88.3 | 81.5 | 86.7 | 82.0 |
| (G) Wt. of Butt w/o Grip as % of Total Wt. | 7.8 | 8.2 | 8.2 | 7.4 | 7.4 | 7.6 | 7.3 | 9.1 | 9.4 | 8.4 | 8.8 | 8.6 | 8.5 | 8.2 | 8.9 | 8.7 | 8.0 |
| (H) Wt. of Butt w/o Grip as % of Shaft Wt. | 25.9 | 26.5 | 25.7 | 26.2 | 25.1 | 25.1 | 30.4 | 28.5 | 31.1 | 27.0 | 28.0 | 26.9 | 26.7 | 25.9 | 28.5 | 27.2 | 26.4 |
| (I) Wt. of Butt w/Grip as % of Total Wt. | 18.8 | 18.7 | 17.8 | 22.0 | 21.4 | 21.4 | 22.6 | 23.4 | 23.4 | 22.1 | 23.0 | 22.3 | 22.4 | 22.5 | 22.0 | 22.7 | 22.1 |
| (J) Wt. of Butt w/Grip as % of Shaft Wt. | 62.5 | 60.2 | 55.8 | 77.6 | 72.8 | 70.9 | 94.0 | 73.6 | 77.7 | 71.0 | 73.0 | 69.9 | 70.1 | 71.6 | 70.9 | 70.9 | 72.5 |
| (K) Wt. of Grip as % of Total Wt. | 9.9 | 9.3 | 8.5 | 14.0 | 13.1 | 13.0 | 14.4 | 13.3 | 14.1 | 13.7 | 14.2 | 13.7 | 13.9 | 14.3 | 13.2 | 14.0 | 14.0 |
| (L) Wt. of Grip as % of Shaft Wt. & Grip | 24.7 | 23.0 | 20.4 | 33.0 | 30.8 | 30.1 | 37.5 | 29.5 | 31.8 | 30.6 | 31.0 | 30.0 | 30.3 | 31.3 | 29.7 | 30.4 | 31.5 |
| (M) Wt. of Head as % of Total Wt. | 58.9 | 58.4 | 58.2 | 56.8 | 56.4 | 55.9 | 60.6 | 53.9 | 54.9 | 54.2 | 53.5 | 53.6 | 53.3 | 53.5 | 54.9 | 53.0 | 54.7 |
| (N) Reduction in Wt. of Butt w/Grip Absolute | — | — | — | 16.9 | 14.5 | 18.2 | 15.6 | 23.7 | 28.0 | 18.7 | 23.7 | 21.1 | 19.4 | 24.1 | 17.3 | 22.5 | 17.8 |
| (O) Reduction in Wt. of Butt w/Grip % | — | — | — | 20.7 | 18.4 | 23.0 | 19.5 | 27.0 | 30.4 | 22.6 | 27.0 | 24.7 | 23.2 | 27.3 | 21.2 | 26.0 | 21.7 |
| (P) Reduction in Wt. of Butt w/o Grip % | — | — | — | 0.7 | — | — | — | 5.8 | 8.7 | 3.3 | 5.5 | 4.7 | 3.6 | 3.8 | 4.6 | 5.1 | 1.7 |
| (Q) Reduction in Wt. of Butt w/o Grip % | — | — | — | 2.5 | — | — | — | 17.1 | 23.6 | 10.5 | 16.3 | 14.3 | 11.3 | 11.9 | 14.0 | 15.3 | 5.7 |
| (R) Reduction in Wt. of Grip Absolute | — | — | — | 17.7 | 16.3 | 18.9 | 19.1 | 18.1 | 23.4 | 19.5 | 22.3 | 20.5 | 19.9 | 24.4 | 16.8 | 21.5 | 20.2 |
| (S) Reduction in Wt. of Grip % | — | — | — | 34.2 | 33.8 | 39.3 | 37.5 | 36.2 | 42.3 | 37.9 | 41.1 | 39.1 | 38.4 | 43.3 | 34.5 | 40.3 | 38.8 |
| (T) Reduction in Wt. of Head Absolute | — | — | — | 7.8 | 7.3 | 7.7 | 14.0 | 2.0 | 16.0 | 2.6 | 4.2 | 4.9 | — | 9.2 | 2.9 | 1.8 | 3.0 |
| (U) Reduction in Wt. of Head % | — | — | — | 3.7 | 3.5 | 3.7 | 6.5 | 1.0 | 7.4 | 1.3 | 2.1 | 2.4 | — | 4.4 | 1.4 | 0.9 | 1.5 |
| (V) Moment of Inertia | 15450 | 15265 | 14968 | 15730 | 15697 | 15755 | 15698 | 15642 | 16022 | 15718 | 15817 | 15915 | 15851 | 16085 | 15706 | 15842 | 15705 |
| (W) Center of Gravity | 11.43 | 11.5 | 11.43 | 12.65 | 12.44 | 12.56 | 12.14 | 12.89 | 13.97 | 12.91 | 13.08 | 13.03 | 13.26 | 13.86 | 12.73 | 13.31 | 12.91 |

TABLE D

| | #2 Iron Clubs | | | | | | | | | | | | | | |
|---|---|---|---|---|---|---|---|---|---|---|---|---|---|---|---|
| | 1-R | 1-S | 1-X | 2-R | 2-S | 2-X | 3-S | 4-S | 5-S | 6-S | 7-S | 8-S | 9-S | 10-S | 11-S |
| (A) Total Club Wt. | 381.3 | 379.5 | 381.2 | 404.6 | 408.5 | 409.1 | 389.1 | 418.2 | 416.5 | 432.9 | 421.8 | 418.8 | 423.4 | 417.8 | 415.0 |
| (B) Shaft Wt. | 101.2 | 103.2 | 110.6 | 105.2 | 109.0 | 109.7 | 78.9 | 133.5 | 121.2 | 120.9 | 126.3 | 117.5 | 136.5 | 123.3 | 116.9 |
| (C) Head Wt. | 239.5 | 238.5 | 234.7 | 242.0 | 242.5 | 241.9 | 253.8 | 226.8 | 244.9 | 252.0 | 239.2 | 251.6 | 234.7 | 240.7 | 247.4 |
| (D) Grip Wt. | 36.6 | 34.0 | 32.0 | 52.0 | 51.6 | 52.0 | 51.2 | 52.9 | 50.4 | 60.0 | 56.3 | 49.7 | 52.2 | 53.8 | 50.7 |
| (E) Butt w/o Grip Wt. | 27.3 | 26.7 | 29.0 | 28.1 | 28.8 | 28.9 | 26.0 | 35.0 | 35.3 | 41.1 | 35.1 | 36.6 | 36.5 | 33.0 | 34.5 |
| (F) Butt w/Grip wt. | 68.8 | 64.9 | 65.3 | 83.3 | 83.4 | 84.8 | 80.5 | 87.9 | 85.7 | 101.1 | 91.4 | 86.3 | 88.7 | 86.8 | 85.2 |
| (G) Wt. of Butt w/o Grip as % of Total Wt. | 7.2 | 7.0 | 7.6 | 6.9 | 7.1 | 7.1 | 6.7 | 8.4 | 8.5 | 9.5 | 8.3 | 8.7 | 8.6 | 7.9 | 8.3 |
| (H) Wt. of Butt w/o Grip as % of Shaft Wt. | 27.0 | 25.9 | 26.2 | 26.7 | 26.4 | 26.3 | 33.0 | 26.2 | 29.1 | 34.0 | 27.8 | 31.1 | 26.7 | 26.8 | 29.5 |
| (I) Wt. of Butt w/Grip as % of Total Wt. | 18.0 | 17.1 | 17.1 | 20.6 | 20.4 | 20.7 | 20.7 | 21.0 | 24.3 | 23.4 | 21.7 | 20.6 | 20.9 | 20.8 | 20.5 |
| (J) Wt. of Butt w/Grip as % of Shaft Wt. | 68.0 | 62.9 | 59.0 | 79.2 | 76.5 | 77.3 | 102.0 | 65.8 | 83.4 | 83.6 | 72.4 | 73.4 | 65.0 | 70.4 | 72.9 |
| (K) Wt. of Grip as % of Total Wt. | 9.6 | 10.0 | 8.4 | 12.9 | 12.7 | 13.2 | 12.6 | 12.1 | 13.9 | 13.3 | 11.9 | 12.3 | 12.9 | 12.2 | |
| (L) Wt. of Grip as % of Shaft Wt. & Grip | 36.2 | 32.9 | 28.9 | 49.4 | 47.3 | 47.4 | 39.5 | 39.6 | 41.5 | 49.6 | 44.6 | 42.3 | 38.2 | 43.6 | 43.4 |
| (M) Wt. of Head as % of Total Wt. | 62.8 | 62.8 | 61.6 | 59.8 | 59.4 | 59.1 | 65.2 | 54.2 | 58.8 | 58.2 | 56.7 | 60.1 | 55.4 | 57.6 | 59.6 |
| (N) Reduction in Wt. of But w/Grip Absolute | — | — | — | 14.5 | 18.5 | 19.5 | 15.6 | 23.0 | 20.8 | 36.2 | 26.5 | 21.4 | 23.8 | 21.9 | 20.3 |
| (O) Reduction in Wt. of Butt w/Grip % | — | — | — | 17.4 | 22.1 | 23.0 | 19.4 | 26.2 | 24.3 | 35.8 | 29.0 | 24.8 | 26.8 | 25.2 | 23.8 |
| (P) Reduction in Wt. of Butt w/o Grip Absolute | — | — | — | 0.8 | 2.1 | — | — | 8.3 | 8.6 | 14.4 | 8.4 | 9.9 | 9.8 | 6.3 | 7.8 |
| (Q) Reduction in Wt. of Butt w/o Grip % | — | — | — | 2.8 | 7.3 | — | — | 23.7 | 24.4 | 35.0 | 23.9 | 27.0 | 26.8 | 19.1 | 22.6 |
| (R) Reduction in Wt. of Grip Absolute | — | — | — | 15.4 | 17.6 | 20.0 | 17.5 | 18.9 | 16.4 | 26.0 | 22.3 | 15.7 | 18.2 | 19.8 | 16.7 |
| (S) Reduction in Wt. of Grip % | — | — | — | 29.6 | 34.1 | 38.5 | 34.0 | 35.7 | 32.5 | 43.3 | 39.6 | 31.6 | 34.9 | 36.8 | 32.9 |
| (T) Reduction in Wt. of Head Absolute | — | — | — | 2.5 | 4.0 | 7.2 | 15.3 | — | 6.4 | 13.5 | 0.7 | 13.1 | — | 2.2 | 8.9 |
| (U) Reduction in Wt. of Head % | — | — | — | 1.0 | 1.6 | 3.0 | 6.0 | — | 2.6 | 5.4 | 0.3 | 5.2 | — | 0.9 | 3.6 |
| (V) Moment of Inertia | 14686 | 14694 | 14396 | 14945 | 15028 | 14970 | 14989 | 15106 | 15212 | 15284 | 15193 | 15026 | 15056 | 15194 | 15082 |
| (W) Center of Gravity | 9.06 | 9.06 | 9.22 | 10.2 | 10.31 | 10.38 | 9.05 | 10.13 | 10.44 | 10.88 | 10.47 | 9.91 | 10.31 | 10.50 | 10.34 |

The clubs designated 1-R, 1-S and 1-X are clubs constructed in accordance with the teachings of the present invention at flexes R, S, and X and using shafts constructed of 4140 steel alloy. The remaining clubs designated 2 through 13 represent typical prior art club constructions. Of these, the clubs designated 2-R, 2-S and 2-X are constructed with shafts of the same 4140 steel alloy as in the present invention. Club 3-S is constructed with a shaft of graphite epoxy while the remaining shafts 4-S through 13-S are constructed with shafts of steel generally weighing more than the shafts of the 2-S type. Table C is specific to the number one wood clubs while Table D sets forth the specifications for the number two iron.

The clubs of applicants' invention and the 2-R, 2-S and 2-X type clubs have an overall length of 43¼" for number one wood and 39¼" for the number two iron. Many of the remaining prior art clubs were assembled with lengths as much as ½" less. All of the heads were the same style to give a swingweight of D3. The effects of reduced length are to increase the weight and decrease the moment of inertia at a given swingweight.

The improved clubs of applicants' invention, at each of the flexes R, S and X, are compared to the comparable clubs using the same 4140 steel alloy. With respect to the remaining clubs, however, the comparison is simply made with the S flex clubs.

From the total club weights given at line A of Tables C and D, it is readily apparent that clubs constructed in accordance with the teachings of the present invention are significantly lighter than the comparable prior art clubs. Line C shows that the head weights are also generally lighter with applicants' invention.

Of the other figures given in Tables C and D, the total weight of the butt end section as a percentage of the total weight of the club (line I) is significant in distinguishing applicants' invention from the constructions of the prior art. In particular, it will be noted that in each case, the percentage weight of the butt end section relative to the total weight of the club for conventional clubs is greater than 20% while with applicants' improved construction, this percentage weight is reduced to between 17 and 19%.

Another significant comparative figure is the weight of the head as a percentage of the total weight (line M). From Table C it will be noted that with respect to wood clubs, this percentage weight in applicants' improved club ranges between 58 and 59% while with the irons, the range is between 61 and 63%.

Line V of Tables C and D gives the dynamic moment of inertia of the clubs constructed in accordance with the present invention and also the moment of inertia of conventional clubs. With respect to the number one wood, it is seen that the moment of inertia is reduced from more than 15,600 oz.in.$^2$ to between 14,900 and 15,500 oz.in.$^2$. With irons, a similar reduction from above 14,900 oz.in.$^2$ to between 14,300 and 14,700 oz.in.$^2$ is produced with applicants' invention.

As indicated above, a reduction in the dynamic moment of inertia is an important feature of applicants' invention. This moment of inertia relates to rotational motion as weight rotates to linear motion.

Weight is a measure of the force required to produce linear acceleration while the moment of inertia about an axis is a measure of the torque applied about that axis for producing an angular acceleration about the axis. Since a golf club swing involves both translation (linear motion) and rotation, reduction in both weight and moment of inertia contribute to increasing golf performance and in particular, the speed at which the golf club head impacts with the ball and the distance which the ball is carried.

With respect to the dynamic motion of the golf club during a swing, the precise axis of rotation changes somewhat during the swing but it is well approximated by the axis through the butt end 6 of the club. At any instant the applied force required to produce the needed linear acceleration is proportional to the mass (weight) of the club, so the effect of reducing the club's mass is to increase the linear acceleration produced by a given force input, and in turn increase the linear velocity. The applied torque required to produce the necessary angular acceleration is proportional to the moment of inertia of the club about the axis about which the club is being rotated. Since this axis is reasonably well approximated by the axis through the butt end of the club, the club's moment of inertia about the butt end is a good measure of the applied torque required to produce a given angular acceleration. The effect of reducing this moment of inertia is to increase the angular acceleration of the club. Therefore, reductions in both the mass and the moment of inertia of the club about an axis through its butt end, result in increased club head speed at impact.

Table E below sets out the results of pertinent computations made with respect to the moment of inertia of clubs constructed in accordance with the teachings of applicants' invention and club constructions not including the features of applicants' invention.

TABLE E

| | MATHEMATICAL CALCULATIONS | | | | | | | | | PERFORMANCE TESTS (MECHANICAL GOLFER) | | | | |
|---|---|---|---|---|---|---|---|---|---|---|---|---|---|---|
| | LINEAR MOTION | | | | | ROTATIONAL MOTION | | | | | | | | |
| Club | Weight oz (1) | Club Head Speed ft/sec (2) | Club Head Weight oz (3) | Initial Ball Speed ft/sec (4) | Carry Distance yds (5) | Moment of Inertia oz.in.$^2$ (6) | Club Head Speed ft/sec (7) | Initial Ball Speed ft/sec (8) | Carry Distance yds (9) | Club Weight oz (10) | Club Head Weight oz (11) | Moment of Inertia oz.in.$^2$ (12) | Club Head Speed ft/sec (13) | Carry Distance yds (14) |
| Wood Invention | | | | | | | | | | | | | | |
| (1-S) A | 12.09 | 156.2 | 7.06 | 228.7 | 240.1 | 15265 | 152.9 | 223.9 | 232.9 | 12.09 | 7.01 | 15350 | 152.7 | 234.3 |
| (2-S) B | 12.97 | 150.8 | 7.32 | 222.2 | 230.3 | 15697 | 150.8 | 222.3 | 230.5 | 13.04 | 7.28 | 15730 | 150.8 | 230.6 |
| (3-S) C | 12.47 | 153.8 | 7.56 | 228.0 | 239.0 | 15698 | 150.8 | 223.5 | 232.2 | 12.44 | 7.55 | 15700 | 150.2 | 232.1 |
| (4-S-13-S) (Iron) | 13.39 | 148.4 | 7.14 | 217.7 | 223.6 | 15791 | 150.3 | 220.5 | 227.8 | 13.38 | 7.14 | 15790 | 150.6 | 227.3 |
| Invention (1-S) | 13.39 | 140.7 | 8.41 | 212.4 | — | 14694 | 137.13 | 206.97 | — | 13.51 | 8.28 | 14730 | 137.3 | 195.0 |

TABLE E-continued

| | MATHEMATICAL CALCULATIONS | | | | | | | | | PERFORMANCE TESTS (MECHANICAL GOLFER) | | | | |
|---|---|---|---|---|---|---|---|---|---|---|---|---|---|---|
| | LINEAR MOTION | | | | | ROTATIONAL MOTION | | | | | | | | |
| Club | Weight oz (1) | Club Head Speed ft/sec (2) | Club Head Weight oz (3) | Initial Ball Speed ft/sec (4) | Carry Distance yds (5) | Moment of Inertia oz.in.$^2$ (6) | Club Head Speed ft/sec (7) | Initial Ball Speed ft/sec (8) | Carry Distance yds (9) | Club Weight oz (10) | Club Head Weight oz (11) | Moment of Inertia oz.in.$^2$ (12) | Club Head Speed ft/sec (13) | Carry Distance yds (14) |
| A (2-S) | 14.41 | 135.6 | 8.55 | 205.2 | — | 15028 | 135.6 | 205.2 | — | 14.33 | 8.47 | 15030 | 135.6 | 192.3 |
| B (3-S) | 13.72 | 139.0 | 8.95 | 211.9 | — | 14989 | 135.77 | 206.93 | — | 13.73 | 8.95 | 14990 | 134.7 | 188.9 |
| C (4-S-11-S) | 14.77 | 133.9 | 8.42 | 202.1 | — | 15152 | 135.0 | 203.8 | — | 14.77 | 8.42 | 15150 | 135.7 | 188.8 |

The club of applicants' invention is designated as 1-S for both the wood and the iron. These clubs are of the same construction as the 1-S clubs in Tables C and D using a shaft of 4140 steel alloy. Clubs A are clubs comparable to club 2-S of Tables C and D using a shaft of the same weight 4140 steel alloy but without the features of applicants' invention. Clubs B are comparable to club 3-S in Tables C and D and include a shaft of graphite-epoxy, again without the features of applicants' invention. Finally, clubs C are comparable to 4-S through 13-S in Tables C and D using steels, such as 4140 steel alloy, but generally having weights of about 178 oz. heavier than clubs A. The heads used with each of the clubs A, B, and C were designed to give a swingweight of D3 to each of the clubs.

The effects of reducing the mass and moment of inertia of the clubs can be readily understood by examining a simplified analysis in which the two types of motion are considered separately.

With respect to linear motion, the applied force is related to the resulting linear acceleration by Newton's second law, $$F=ma \tag{2}$$

where:

m=mass of the club a=acceleration.

This shows that a given applied force will produce increased acceleration as the mass (or weight) is decreased.

The energy associated with the translation is given by the equation:

$$E=(mv^2)/2 \tag{3}$$

where:

m=mass of the club v=linear velocity.

Therefore, with constant energy input the resultant velocity is related to the mass by the expression:

$$v=K\sqrt{1/m} \tag{4}$$

where: K=a constant.

If the weights of the four basic club types 1-S (applicants' invention), A (2-S), B (3-S) and C (4-S through 13-S) are put into this expression and a measured club head speed at impact of 150.8 feet per second is used for the 2-S driver, the velocities for the other drivers can be calculated. These club head speeds are set out in column 2 of Table E. Thus, if the motion were pure translation, the club 1-S constructed in accordance with the present invention would give the highest club head speed of 156.2 ft./sec.

To carry the example further, the initial ball speed can be found using the expression:

$$V_{ball}=\frac{(V_{club\ head})(1+C_R)}{1+\left(\frac{W\ \text{ball}}{W\ \text{Club head}}\right)}=\frac{1.800\ (V_{club\ head})}{1+\left(\frac{1.62\ \text{oz.}}{W_{club\ head}}\right)} \quad \text{(Equation 5)}$$

where:

$C_R$=coefficient of restitution for the ball (0.800)

$W_{ball}$=weight of the ball (1.62 oz.)

$W_{club\ head}$=weight of the club head.

Analysis of this expression shows that although reducing head weight reduces ball speed, this effect is not large enough to offset the increased club head speed that results. Putting the club head speeds and the head weights for the driver clubs of Table E into the expression (5), the initial ball speeds for the different drivers can be calculated. These results which are shown in column 4 of Table E indicate that if the motion were entirely translation, the driver of the present invention would produce the greatest initial ball speed.

The highest ball speed, of course, produces the greatest distance. Putting the values of ball speed into the empirical expression for driver carry distance:

$$d_{carry}=1.5V_{ball}-103 \tag{6}$$

where:

$d_{carry}$=the carry distance in yards $V_{ball}$=the initial ball speed in feet per second, the carry distances can be determined. These results are shown in column 5 of Table E. Therefore, if the motion were all linear (even without the effects of reduced moment of inertia for applicants' improved club) driver 1-S would produce the greatest distance.

Similar results are obtained in parallel calculations for the two irons of Table E. Applicants do not have an empirical expression between ball speed and distance for two irons. However, clearly from observing the driver calculations, the greatest ball speed correlates with the greatest carry distance.

With respect to rotational motion, the moment of inertia is the rotational analog of force. The moment of inertia I of an object about any axis is the sum of all the scalar elements $r^2\Delta m$, where: r is the perpendicular distance from the axis to the mass element $\Delta m$. This is expressed by the equation:

$$I=\Sigma r^2\Delta m \tag{7}$$

The rotational axis of the golf club is approximated by the axis perpendicular to the shaft and through the butt end of the club. Since the head represents most of the club's mass and is the farthest from the axis, the moment of inertia of the club is largely determined by the head's mass, and reductions of the moment of inertia are most effectively accomplished by reducing the weight of the head.

Torque is the rotational analog of force. The torque (L) about an axis is the sum of the products of the distances (r) from the axis to the points of application of the forces (F) and the components $F_\perp$ of the forces perpendicular to the radius ($F_\perp = F \sin \theta$). These forces are represented schematically in FIG. 6.

The applied torque is related to the resulting angular acceleration by the rotational analog of Newton's law, $$L = I\alpha \tag{8}$$

where: $\alpha$ is the angular acceleration. This means that a given applied torque will produce increased angular acceleration as the moment of inertia is decreased.

The energy associated with the rotational motion is given by:

$$E = I\omega^2/2 \tag{9}$$

where:

I is the club's moment of inertia $\omega$ is the angular velocity.

The angular velocity is related to club head speed by the expression:

$$v_{head} = l\omega \tag{10}$$

where: l is approximately the length of the club. Therefore, with constant energy input the resultant head speed is related to the moment of inertia by the expression:

$$v = l\omega = l\sqrt{(2E/I)} = K\sqrt{(1/I)} \tag{11}$$

where: K is a constant.

If the moments of inertia of the clubs of Table E are put into the equation 11 and a measured club head speed of 150.8 ft./sec. is used for driver club A (2-S), the club head speeds of the remaining clubs can be calculated. These results are shown in column 7 of Table E. Thus, if the motion were entirely rotational the wood club (1-S) constructed in accordance with applicants' invention would develop the greatest club head speed for a given constant energy input level.

In calculating the club head speed of column 7, it is noted that the amount of inertia about the butt end of the club must first be determined. The values measured by the applicants are given in Tables C and D at line V. Not only are these values used in calculating club head speed, they are themselves significant in distinguishing applicants' invention over the prior art.

In determining the moment of inertia about the butt end of the club, the moment of inertia about the center of gravity of the club is first determined. To this is added the value represented by the weight of the club times the square of the distances from the butt end 6 to the center of gravity. This calculation is represented by the following equation:

$$I_b = Icg + md^2. \tag{12}$$

The moment of inertia about the center of gravity of the club is determined by conventional measuring apparatus. Such an apparatus is manufactured by Inertia Dynamics of Coatesville, Conn. In this apparatus, the club is suspended on a wire from its center of gravity so that it lies in a horizontal plane. The club is then twisted in one direction and a measure taken of the period (+), the time of one complete swing in one direction and then back in the other direction to the starting point. The moment of inertia about the center of gravity is represented by the following equation:

$$I = Kt^2 \tag{13}$$

where: K = a function of the apparatus.

After the club head speed is determined from equation 11, using the moment of inertia as determined from equation 12, the initial ball speed can be found from equation 5. They are given in Table E at column 8. Thus, if the motion were entirely rotational, it is seen that the driver club of the present invention (1-S) would produce the greatest initial ball speed. Similar results can be obtained with respect to the irons of Table E and they are also shown in column 8. As with the calculations under linear motion, a measured club head speed of 135.6 ft./sec. is used for the club A to calculate the speeds for the remaining irons.

From equation 6 above, the carry distance due to rotary motion can also be calculated for the drivers of Table E and are given in column 9. Again, applicants have no empirical expression for calculating ball carry distance for the irons; but as with the woods, the carry distance would correspond directly with the club speed and with applicants' improved club construction would be the greatest.

In columns 10–14 of Table E, the results of tests of the various clubs in a mechanical golfer are given. The mechanical golfer is a conventional device which has become a testing standard in the industry. It is pneumatically operated, and the set of forces and torques exerted on the club at each point in the swing are independent of the characteristics of the golf club. Therefore, used at a constant pressure setting, the machine maintains the same energy input with all the clubs. The four drivers of Table E were tested at a constant energy, as were the four irons.

The properties of the test clubs are listed in columns 10–14. Club and head weights and moments of inertia are all very close to the average values determined from actual measurements. The moments of inertia were determined by measuring the periods of oscillation of the clubs about axes through their centers of gravity, calculating from these periods the moments about these axes, and then using the parallel axis theorem to obtain the moments about axes through the butt ends of the clubs. The head speeds just prior to impact were measured in the tests using a simple two-photocell arrangement monitored by a digital counter.

In both the driver tests and the iron tests, these measurements confirmed that the reduced weight and moment of applicants' improved club construction produces the greatest club head speed (column 13). The average carry distances measured in the tests are listed in column 14. They too confirm the calculated results with the clubs of the present invention producing the greatest carry distances.

One final but nevertheless important feature of applicants' invention relates to the location of the center of gravity or balance point of the improved club construction. With applicants' invention, a significant shifting of the center of gravity toward the club head is effected. This results in a greatly increased head feel which contributes to improved club performance. The location of the centers of gravity of the clubs constructed in accordance with the teachings of the present invention as well as those of the prior art constructions which are shown in Tables C and D at line W. Values given at line W are in inches and represent the distance from the balance point to the heel or bottom of the club head. It is noted that a significant shifting of about 1" is created in both the woods and irons with applicants' improved club construction.

Although applicants have described in detail certain specific wood and iron club constructions, the principles of applicants' invention are equally applicable to other clubs of different swingweights and flexes. In addition, the presently preferred construction of applicants' clubs includes a shaft of 4140 steel alloy with a molded rubber grip. Lighter weight or composite materials can be used for the shaft as well as other techniques used for providing a grip as long as the weight and moment of inertia reductions are effected.

We claim:

1. The method of making a lightweight golf club characterized in that:

(a) establishing the parameters of a golf club having a predetermined swingweight, a normal weight of the butt end section, including the grip, which is greater than 20% of the total normal weight of the club including the grip, club shaft and head, and a moment of inertia ($I_b$) as measured about the butt end of the club by the equation $I_b = Icg + md^2$ where:

Icg = moment of inertia of club about its center of gravity (oz.in.)

m = total mass (weight) of club (oz.)

d = distance between the butt end and center of gravity of club (in.);

(b) constructing the butt end section, including the grip, of the club with a weight less than 20% of the total weight of the club to reduce the weight and moment of inertia of the club; and (c) constructing the head with a weight sufficient to give said predetermined swingweight with the butt end section of reduced weight.

2. The method of making a lightweight golf club characterized in that:

(a) establishing the parameters of a golf club having a predetermined swingweight, a normal weight of the butt end section, including the grip, which is greater than 20% of the total normal weight of the club including the grip, club shaft and head, a club shaft with a predetermined shaft thickness and outer diameter at its butt end section, and a grip of predetermined grip thickness and outer diameter and a moment of inertia ($I_b$) as measured about the butt end of the club by the equation $I_b = Icg + md^2$ where:

Icg = moment of inertia of club about its center of gravity (oz.in.)

m = total mass (weight) of club (oz.)

d = distance between the butt end and center of gravity of club (in.);

(b) constructing the butt end section, including the grip, of the club with a weight less than 20% of the total weight of the club to reduce the weight and moment of inertia of the club by:

(1) enlarging the outer diameter of the club shaft at the butt end section, (2) decreasing the thickness of the club shaft at the butt end section, and (3) decreasing the thickness of the grip; and (c) constructing the head with a weight sufficient to give said predetermined swingweight with the butt end section of reduced weight.

3. The method of making a lightweight golf club wood according to claim 2, further characterized in that:

(a) the club is constructed with a total weight between 340 and 345 grams and a moment of inertia of between 14,900 and 15,500 oz.in.$^2$;

(b) the butt end section is constructed with a weight of between 60 and 65 grams; and (c) the head is constructed with a weight of between 58 and 59% of the total weight of the club.

4. The method of making a lightweight golf club iron according to claim 2, further characterized in that:

(a) the club is constructed with a total weight between 378 and 383 grams and a moment of inertia of between 14,300 and 14,700 oz.in.$^2$;

(b) the butt end section is constructed with a weight of between 64 and 70 grams; and (c) the head is constructed with a weight of between 61 and 63% of the total weight of the club.

5. The method of making a lightweight golf club characterized in that:

(a) establishing the parameters of a golf club having a predetermined swingweight, a normal weight of the butt end section, including the grip, which is greater than a predetermined percentage of the total normal weight of the club including the grip, club shaft and head, a club shaft with a predetermined shaft thickness and outer diameter at its butt end section, and a grip of predetermined grip thickness and outer diameter and a moment of inertia ($I_b$) as measured about the butt end of the club by the equation $I_b = Icg + md^2$ where:

Icg = moment of inertia of club about its center of gravity (oz.in.)

m = total mass (weight) of club (oz.)

d = distance between the butt end and center of gravity of club (in.);

(b) constructing the butt end section, including the grip, of the club with a weight less than said predetermined percentage of the total weight of the club while maintaining about the same outer diameter of said grip at the butt end section by:

(1) enlarging the outer diameter of the club shaft at the butt end section, (2) decreasing the thickness of the club shaft at the butt end section, and (3) decreasing the thickness of the grip; and (c) constructing the head with a weight sufficient to give the same predetermined swingweight with the butt end section of reduced weight.

* * * * *